US008495764B2

(12) United States Patent
Hull

(10) Patent No.: US 8,495,764 B2
(45) **Date of Patent: *Jul. 30, 2013**

(54) AMBIDEXTROUS GLOVE

(71) Applicant: Summit Glove Inc., Minerva, OH (US)

(72) Inventor: James L. Hull, Malvern, OH (US)

(73) Assignee: Summit Glove Inc., Minerva, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/633,952

(22) Filed: Oct. 3, 2012

(65) Prior Publication Data

US 2013/0025024 A1 Jan. 31, 2013

Related U.S. Application Data

(63) Continuation of application No. 13/278,811, filed on Oct. 21, 2011, now Pat. No. 8,302,216, which is a continuation-in-part of application No. 13/237,283, filed on Sep. 20, 2011, now Pat. No. 8,286,264, which is a continuation of application No. 12/421,785, filed on Apr. 10, 2009, now Pat. No. 8,028,348.

(51) Int. Cl.
*A41D 19/00* (2006.01)

(52) U.S. Cl.
USPC ..... 2/163; 2/159

(58) Field of Classification Search
USPC ..... 66/174; 2/161.6, 167, 16, 164, 168, 2/18–19, 158–163, 169, 174
See application file for complete search history.

(56) References Cited

U.S. PATENT DOCUMENTS

| | | | | |
|---|---|---|---|---|
| 2,380,633 | A | 7/1945 | Daiber | |
| 3,883,898 | A | 5/1975 | Byrnes, Sr. | |
| 4,115,873 | A | 9/1978 | Stansbury | |
| 4,534,066 | A | 8/1985 | Hansson | |
| 4,750,218 | A | 6/1988 | Ziegler | |
| 4,752,973 | A | 6/1988 | Wolfberg et al. | |
| 4,809,365 | A | 3/1989 | Chen et al. | |
| 4,860,385 | A | 8/1989 | Zidele | |
| 5,054,126 | A | 10/1991 | Rivkin | |
| 5,799,333 | A | 9/1998 | McGarry et al. | |
| 5,829,089 | A | 11/1998 | Steadman | |
| 5,833,911 | A | 11/1998 | Llort et al. | |
| 5,848,440 | A | 12/1998 | Pajarola | |
| 5,971,240 | A | 10/1999 | Dequaine | |
| 6,029,275 | A | 2/2000 | Deprado | |
| 6,289,515 | B1 | 9/2001 | Fous | |
| 7,062,792 | B2 | 6/2006 | Jaunault et al. | |
| 7,356,852 | B2 | 4/2008 | Thai | |
| D602,207 | S | 10/2009 | Hull | |
| 8,028,348 | B2 * | 10/2011 | Hull | 2/163 |
| 8,286,264 | B2 * | 10/2012 | Hull | 2/163 |
| 8,302,216 | B2 * | 11/2012 | Hull | 2/163 |
| 2007/0048504 | A1 | 3/2007 | DiMario | |
| 2007/0087674 | A1 | 4/2007 | Cox | |

(Continued)

*Primary Examiner* — Danny Worrell
(74) *Attorney, Agent, or Firm* — Sand & Sebolt

(57) ABSTRACT

An ambidextrous glove that includes a thumb region, an index finger region, a middle finger region, a ring finger region and little finger region all aligned along a common axis. The index finger region is rotated through ninety degrees relative to the orientations of all of the middle, ring and little finger regions to provide for easier insertion of a hand into the glove. A textured pattern is provided on the surfaces of the glove used to grip objects. The pattern is one of a raised fan shape and raised diamond shape.

17 Claims, 7 Drawing Sheets

U.S. PATENT DOCUMENTS

2008/0098501 A1 5/2008 Takata
2009/0293175 A1 12/2009 Cox
2010/0257656 A1 10/2010 Hull
2013/0025024 A1* 1/2013 Hull ..... 2/163

* cited by examiner

AMBIDEXTROUS GLOVE

CROSS-REFERENCE TO RELATED APPLICATIONS

This is a Continuation of U.S. patent application Ser. No. 13/278,811 filed Oct. 21, 2011, which is a Continuation-in-Part of U.S. patent application Ser. No. 13/237,283 filed Sep. 20, 2011, which is a continuation of U.S. patent application Ser. No. 12/421,785 filed Apr. 10, 2009, now U.S. Pat. No. 8,028,348, the entire specifications of which are incorporated herein by reference.

BACKGROUND OF THE INVENTION

1. Technical Field

This invention generally relates to gloves. More particularly, the invention relates to a protective glove used in the food packaging and processing industries and more particularly the red meat and poultry processing industries. Specifically, the invention relates to an ambidextrous glove that may be used on either of the left hand or the right hand and in which the four finger regions and the thumb region of the glove are aligned along a common axis.

2. Background Information

Gloves are used in the food processing and packaging industries to protect workers' hands from contamination and injury. Workers typically wear a liner that is a cotton knit material or is made from aramid fibers that protect against cuts and abrasions. A thicker, waterproof glove is worn over the liner to protect the worker. These waterproof gloves are typically manufactured from different types of polymers depending on the type of food processing applications they are to be used in. In the chicken processing industry, for instance, these exterior waterproof gloves are typically made from natural rubber latex. In the beef and pork processing industries the gloves are typically made from a variety of synthetic rubbers such as acrylonitrile-butadiene (nitrile), polychloroprene or polyvinyl chloride. The materials used for the gloves in the two industries differ because naturally occurring chemicals in chicken fat tend to attack materials other than natural rubber latex. This leads to a premature breakdown of the glove surface and the glove starts to swell. Once this occurs, the glove has to be thrown away. Since the gloves come in pairs, workers typically have to discard both gloves when only one of them has been damaged. In even a small food processing and packaging plant as many as a container load of undamaged gloves need to be disposed of each year. This tends to drive up the cost of doing business.

There is therefore a need in the industry for an improved glove that will assist in reducing the number of gloves that have to be purchased and discarded.

SUMMARY OF THE INVENTION

The device of the present invention is an ambidextrous glove that is specially designed so that it is able to be worn on either of a left hand or a right hand.

The glove includes a thumb region, an index finger region, a middle finger region, a ring finger region and little finger region all aligned along a common axis. The index finger region is rotated through ninety degrees relative to the orientations of all of the middle, ring and little finger regions to provide for easier insertion of a person's hand into the glove. A textured pattern is provided on the exterior surfaces of the glove used to grip objects. In order to distinguish between the gloves used in poultry processing facilities and beef or pork processing facilities, the gloves are provided with different raised, textured patterns on the exterior surfaces used to grip objects. The pattern preferably is a raised fan-shape or fish-scale shape for poultry processing gloves and a is raised diamond-shape for beef or pork processing gloves. The pattern is raised in texture to aid in gripping and safe handling of the meat product and to aid in directing fluids away from the finger tips.

The glove preferably is of a unitary construction meaning that it is formed so as to be seamless. Preferably, the gloves are formed by dipping a former into a quantity of liquid, removing the coated former and allowing the liquid coating to solidify. The material used to manufacture the gloves preferably is of a 'progressive thickness" meaning that the material in the fingers of the glove comprises the thickest part of the glove.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 3A:
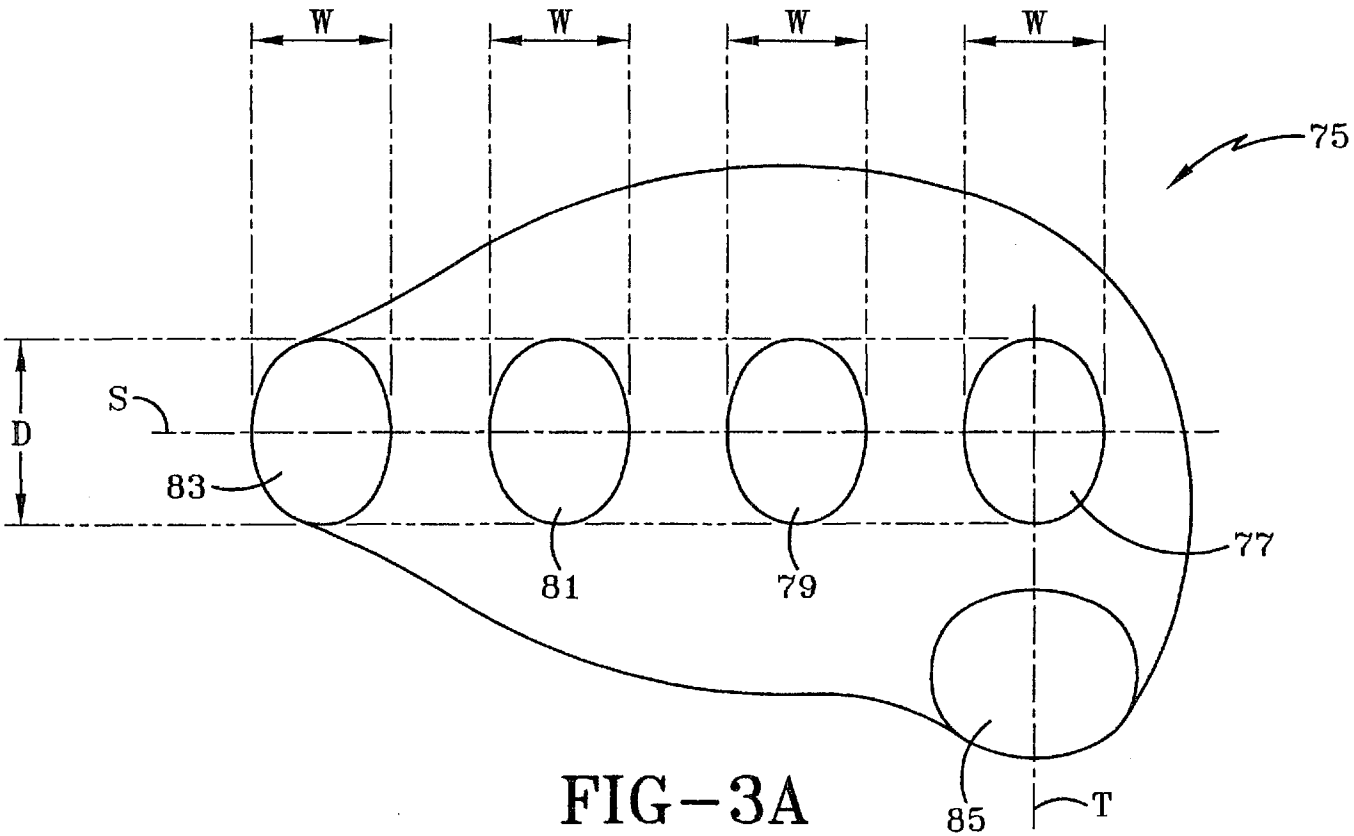
FIG-3A PRIOR ART
FIG. 3*a* is a top view of a prior art glove showing the thumb region disposed out of alignment with the four finger regions.

As will be known to those skilled in the art, there are a variety of voluntary consensus standards laid out for various industries. These voluntary standards are published by organizations such as ASTM International, the American National Standards Institute (ANSI), and the International Organization for Standardization (ISO). These "industry standards" are readily available to those skilled in the art and include industry standards for gloves manufactured on formers or molds. Gloves typically are manufactured in industry standard sizes 7, 8, 9, 10 and 11 or SS, S, M, L and XL. Each of these industry standard sizes has specific dimensions for the width, lengths and circumferences of the various components on the former and thereby on the gloves produced therewith. An example of the dimensions of a standard former for manufacturing prior art gloves is provided hereto as Appendix "A". In the following description, reference will be made to this "industry standard" for a variety of components on the standard former. Additionally, the finger regions and thumb regions on the prior art formers have been arranged in a particular configuration relative to each other. This prior known configuration of an industry standard glove is illustrated in FIG. 3*a* and identified by the reference character 75. The configuration of glove 75 will be discussed later herein. It should be understood by the reader that the inventor regards these previously known "industry standard" formers and the dimensions thereof as set out in Appendix "A" as prior art. It should further be understood and noted that the industry standard glove referred to herein is not an ambidextrous or reversible glove. It is, instead, a glove designed to be worn on either a left hand or a left hand. In the instance illustrated in FIG. 3*a* herein, the glove 75 is configured to be worn only on the right hand. The table in Appendix "A" identifying the industry standard for gloves is provided by way of example only.

Various components on gloves 10, 110 have been measured. It should be understood that the length of each finger is measured as extending between the tip of the finger (or thumb) and the location where that finger or thumb joins the palm region. The circumference of each finger (or thumb) is measured at the midpoint along the length of the finger (or thumb). The palm region's circumference is measured at the midpoint along the thumb-index finger crotch. The wrist circumference is measured as the narrowest measurement of the wrist region.

Figure 1:
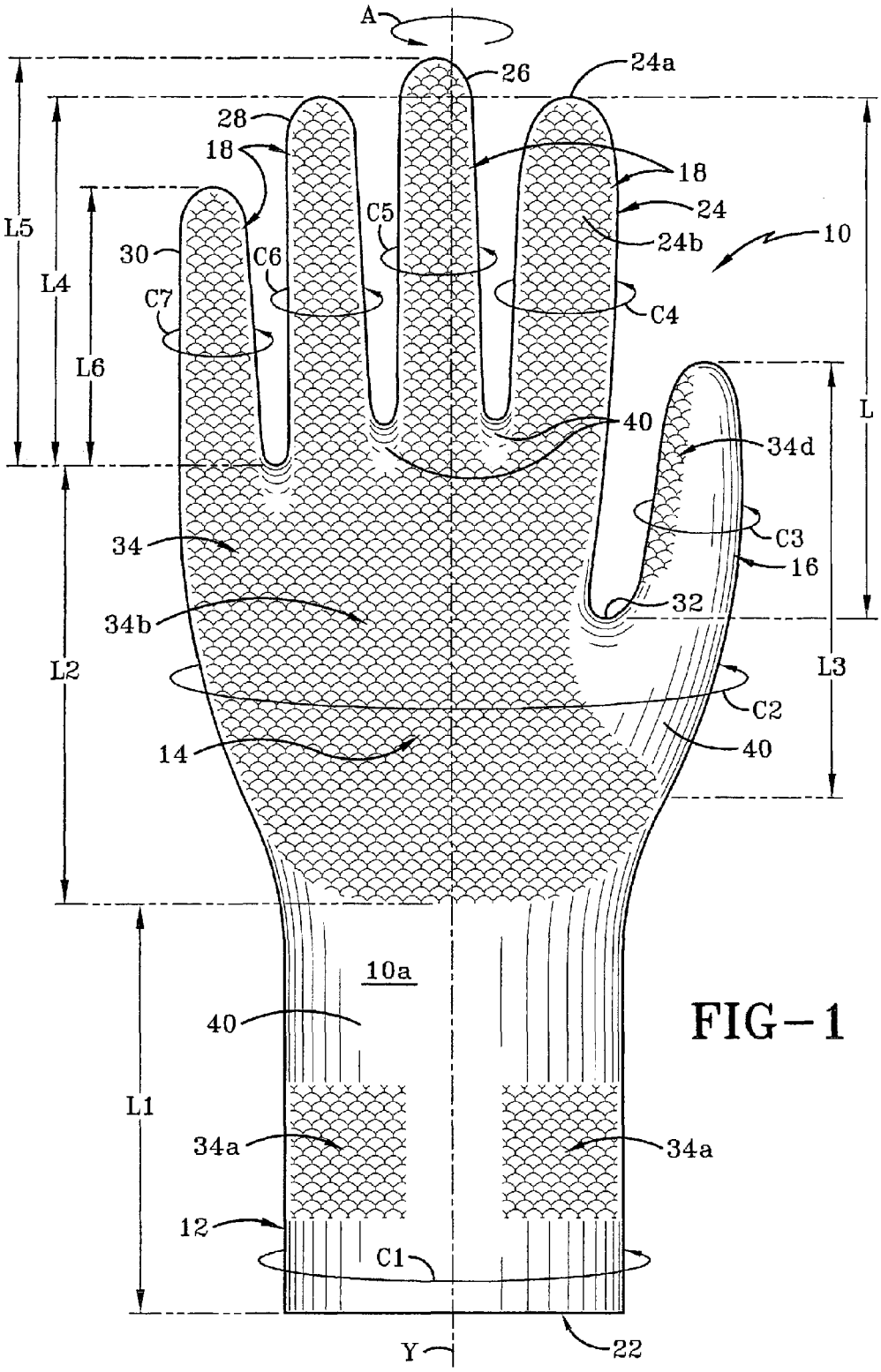
FIG. 1 is a front view of an ambidextrous glove in accordance with the present invention.
Figure 5:
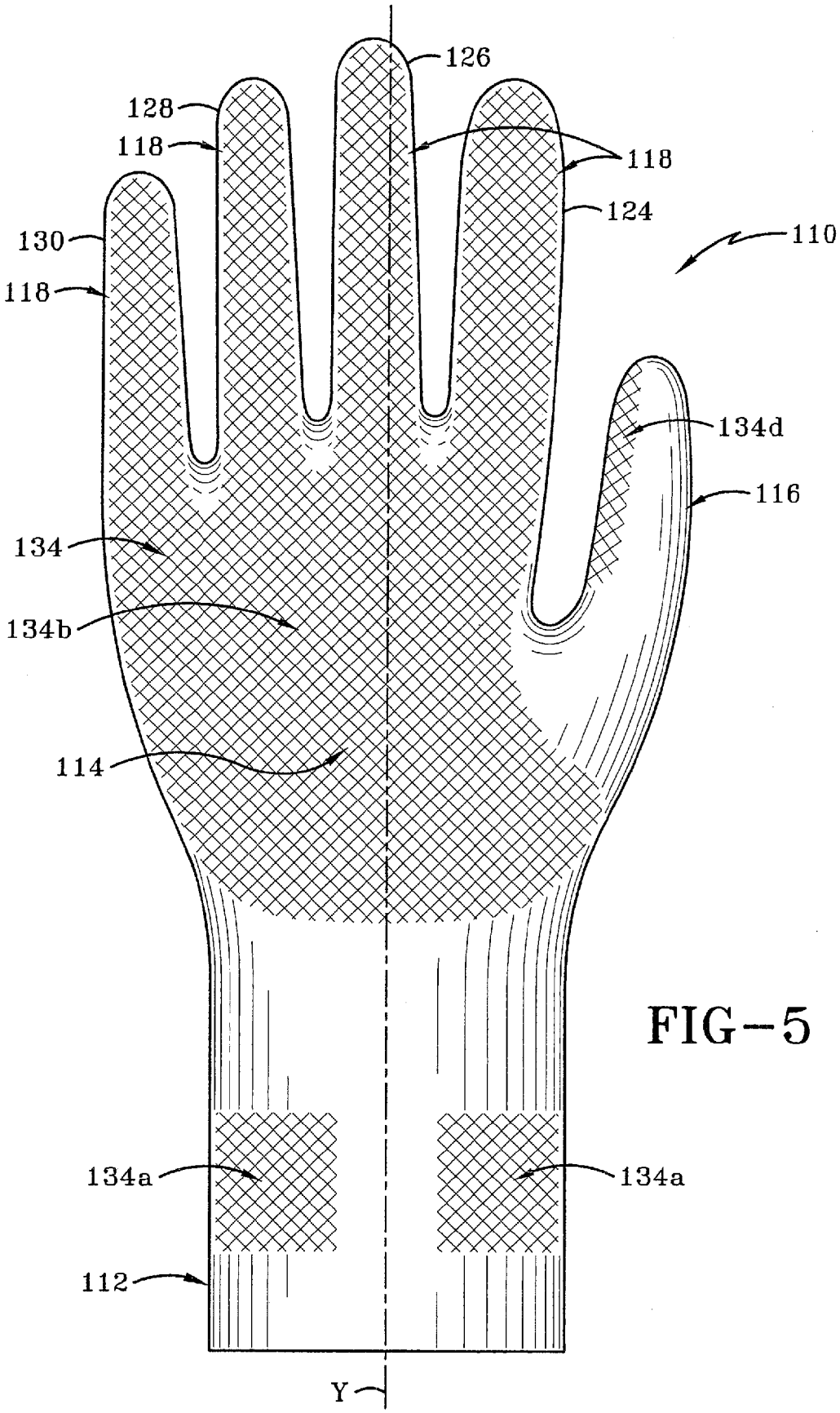
FIG. 5 is a front view of an ambidextrous glove in accordance with the present invention and showing an alternative embodiment of a texture pattern provided thereon.

Referring to FIGS. 1, 2, 3*b*, and 4, there is shown a first embodiment of an ambidextrous or reversible glove in accordance with the present invention being generally indicated at 10. (As indicated above, FIG. 3*a* illustrates a prior art glove 75.) Glove 10 is designed for use in the chicken processing industry and is provided with a fan-shaped or fish-scale shaped gripping pattern on its exterior surface, as will be hereinafter described. A second embodiment of an ambidextrous glove in accordance with the present invention is shown in FIG. 5 and is generally indicated at 110. Glove 110 is designed for use in the beef and pork processing industries and is provided with a raised diamond-shaped gripping pattern on its exterior surface, as will be hereinafter described. Gloves 10 and 110 are ambidextrous or reversible gloves that are designed to be worn on either of a left hand or a right hand. Both of FIGS. 1 and 5 illustrate the glove oriented for placement on a person's left hand. The glove is oriented for placement on a person's right hand by simply turning the glove through 180 mm about a longitudinal axis "Y". This rotation is illustrated by the arrow "A" in FIG. 1.

Referring to FIGS. 1, 2, 3*b* and 4, glove 10 preferably is designed for use in the food processing and packaging industries and is therefore manufactured from any material suitable for use in these industries. Specifically as illustrated in FIG. 1, glove 10 is designed for use in the chicken processing and packaging industries. Glove 10 is therefore preferably manufactured from natural rubber latex having about 60% solids. This material tends not to become damaged when exposed to chicken fat. It will be understood that any suitable material that is more resistant to damage from chicken fat and fluids may be used for the manufacture of glove 10. These suitable materials preferably are also of a type that may be shaped on a former or mold as opposed to materials that must be sewn or otherwise secured together. It should be understood that any suitable material can be used for manufacturing glove for a wide variety of meat processing industries or in other manufacturing operations where an ambidextrous glove would be advantageous. Such industries could include the health industry where medical personnel or laboratory personnel frequently need to change gloves. The materials used to manufacture glove 10 would then be selected based upon the end use of the glove.

As indicated previously, glove 10 is illustrated as being provided with a fish-scale type pattern on a number of surfaces that will contact the product being processed. This pattern provides grip and may be useful for directing fluids away from working surfaces of glove 10. The pattern selected for use on the contact surfaces is selected based on the industry in which glove 10 is to be used. So, while the fish scale pattern is used in the chicken processing industry and a diamond shaped pattern is used in the pork processing industry, any of a wide variety of patterns can be used on the contact or gripping surfaces of gloves 10 or 110, without departing from the scope of the present invention. Additionally, it will be understood that more than one pattern can be simultaneously used on glove 10.

Glove 10 includes a wrist region 12, a palm region 14, a thumb region 16 and four digit regions 18. The four digit regions 18 extend outwardly from palm region 14. Glove 10 has a front exterior surface 10*a* and a back exterior surface 10*b*. The configuration of the glove 10 is such that the front and back surfaces 10*a*, 10*b* are substantially identical in appearance. It should be noted that the terms "front" and "back" are simply used herein in order to reference the specific orientation of glove 10 shown in the attached figures. Obviously, if the glove 10 is rotated through 180 mm, then front surface 10*a* will become the back surface 10*b* and vice versa. Glove 10 preferably is manufactured as a unitary component and is therefore free of seams or other connection means between the various regions.

Wrist region 12 is configured to cover the wrist (not shown) of a person and preferably a portion of their lower forearm. An opening 20 (FIG. 4) is defined at the end 22 of wrist region 12. Opening 20 is sized so as to permit insertion of a hand therethrough.

Glove 10 preferably includes rayon or cotton flocking 21 (FIG. 4) that is is deposited on an inside surface of glove 10. The inside surface is made up of inside surfaces of each of wrist region 12, palm region 14, thumb region 16, index finger region 24, middle finger region 26, ring finger region 28 and little finger region 30. Particularly, flocking 21 is deposited on the inside surface of one or more of the palm region 14, thumb region 16, index finger region 24, middle finger region 26, ring finger region 28, and little finger region 30. Flocking 21 may also be deposited on the inside surface of wrist region 12. Flocking 21 is thereby positioned to contact the worker's hand, making it easier for the worker to pull glove 10 onto their hand. Flocking 21 also makes glove 10 more comfortable to wear.

Wrist region 12 has a circumference C1 and a length L1. The end 22 of wrist region 12 is substantially planar and preferably of a uniform thickness with the rest of wrist region 12. It should be noted that wrist region 12 preferably is free of any longitudinally aligned slits that might extend from the end 22 inwardly toward the digit regions 18 and which might aid in inserting a hand into glove 10. First region 12 preferably is also free of any cuffs and any fastening mechanisms that might be used to secure glove 10 around the wrist or forearm of the wearer.

Palm region 14 extends outwardly away from the innermost end of wrist region 12 opposite end 22. Palm region 14 is configured to cover the front and back of the person's hand and has a circumference C2 and a length L2. The length L2 is measured from the innermost end of wrist region 12 up to the origin zones of the four digit regions 18.

The four digit regions 18 of glove 10 include an index finger region 24, a middle finger region 26, a ring finger region 28 and a little finger region 30 that are adapted to receive an index, middle, ring, and little finger, respectively.

Thumb region 16 also extends outwardly from palm region 14 adjacent digit regions 18 and is adapted to receive a worker's thumb therein. Thumb region 16 and index finger region 24 are separated from each other by a thumb crotch 32 which is configured to permit the thumb region 16 to move easily relative to the palm region 14 and digit regions 18 no matter whether glove 10 is worn on the left hand or the right hand.

Figure 3B:
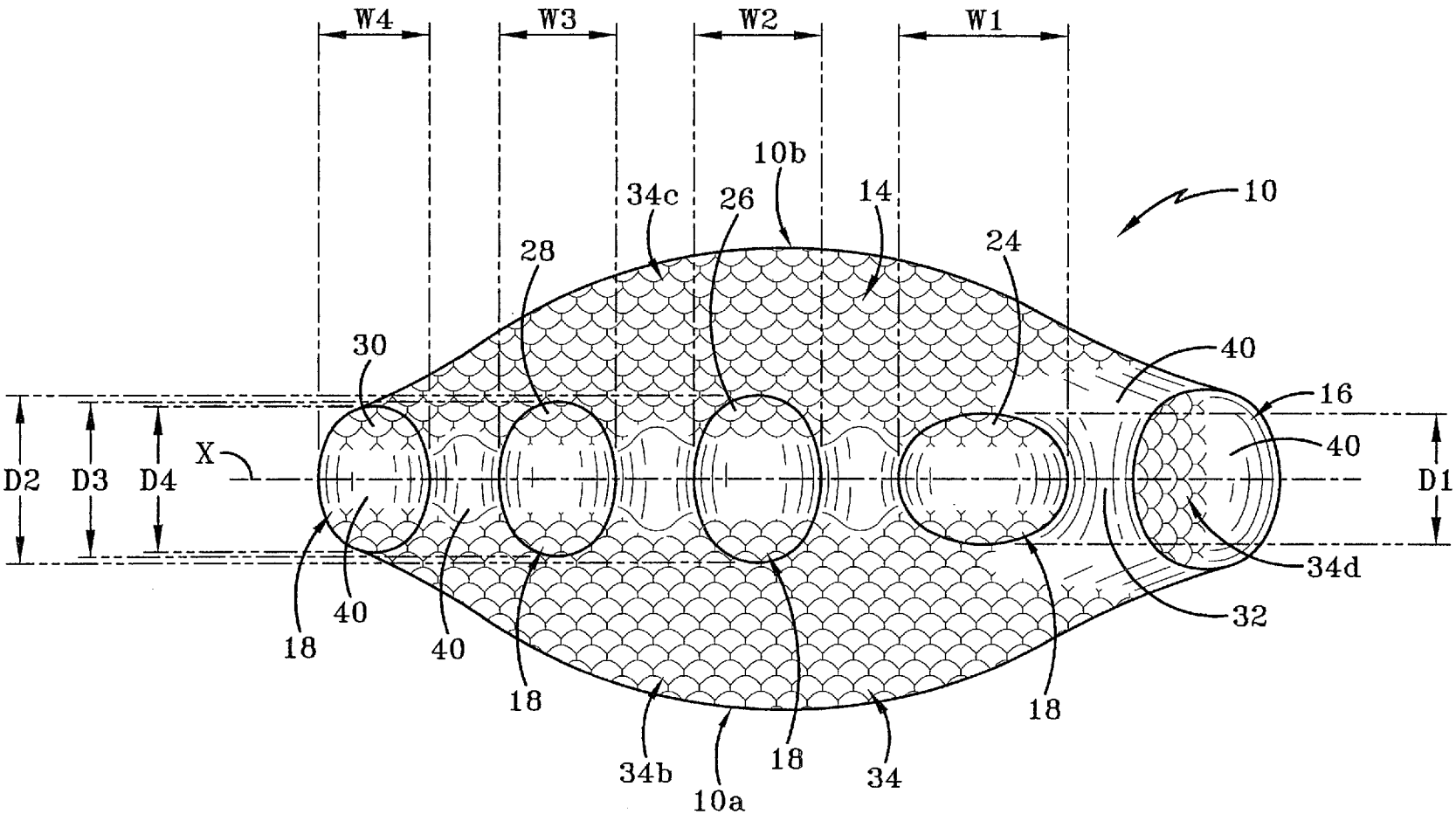
FIG. 3*b* is a top view of the glove of the present invention showing the finger regions and thumb region aligned along a common axis.
Figure 4:
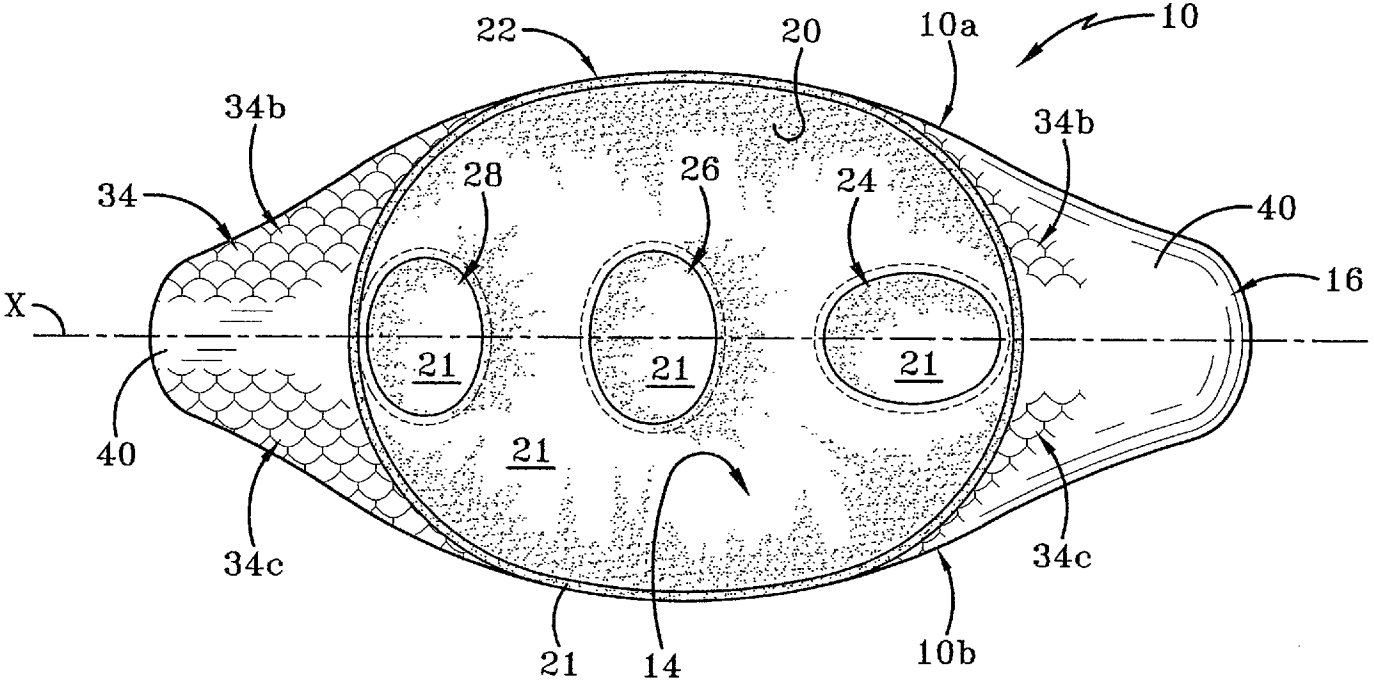
FIG. 4 is a bottom view of the glove of FIG. 1 showing the opening to the glove with the entryways into the index finger region, the middle finger region and the ring finger region being visible together with a portion of the palm region that is disposed between these finger regions.

FIG. 3*a* illustrates a top view of a prior art glove 75 and FIG. 3*b* illustrates a top view of glove 10 in accordance with the present invention. Prior art glove 75 is configured to be worn on a left hand of worker and can only be worn on the left hand. Glove 10 is an ambidextrous glove and is therefore able to be worn on either of a left hand or a right hand of a worker. Prior art glove 75 has an axis "S" that runs through an index finger region 77, a middle finger region 79, a ring finger region 81 and a little finger region 83. Thumb region 85 is to offset relative to axis "S" and is generally positioned a distance forwardly of axis "S" and generally in alignment with index finger region 77 along an axis "T". The axis "T" is disposed generally at right angles to the axis "S". As is evident from FIG. 3*a*, the width "W" of each finger region 77-83 is substantially equal in size and the depth "D" of each finger region 77-83 is substantially equal in size. Additionally, the index finger region 77 has a work surface area that is substantially equal to the width "W". The work surface area is that portion of the finger region that will come into contact with a piece of meat when the glove is used.

FIG. 3*b* illustrates glove 10 of the present invention. In accordance with a specific feature of the present invention, the four digit regions 18 and thumb region 16 are substantially aligned along a common axis "X" and are therefore substantially coplanar. Furthermore, thumb region 16 is disposed alongside index finger region 24 instead of being in front of index finger region as was the case with the prior art gloves 75.

Figure 2:
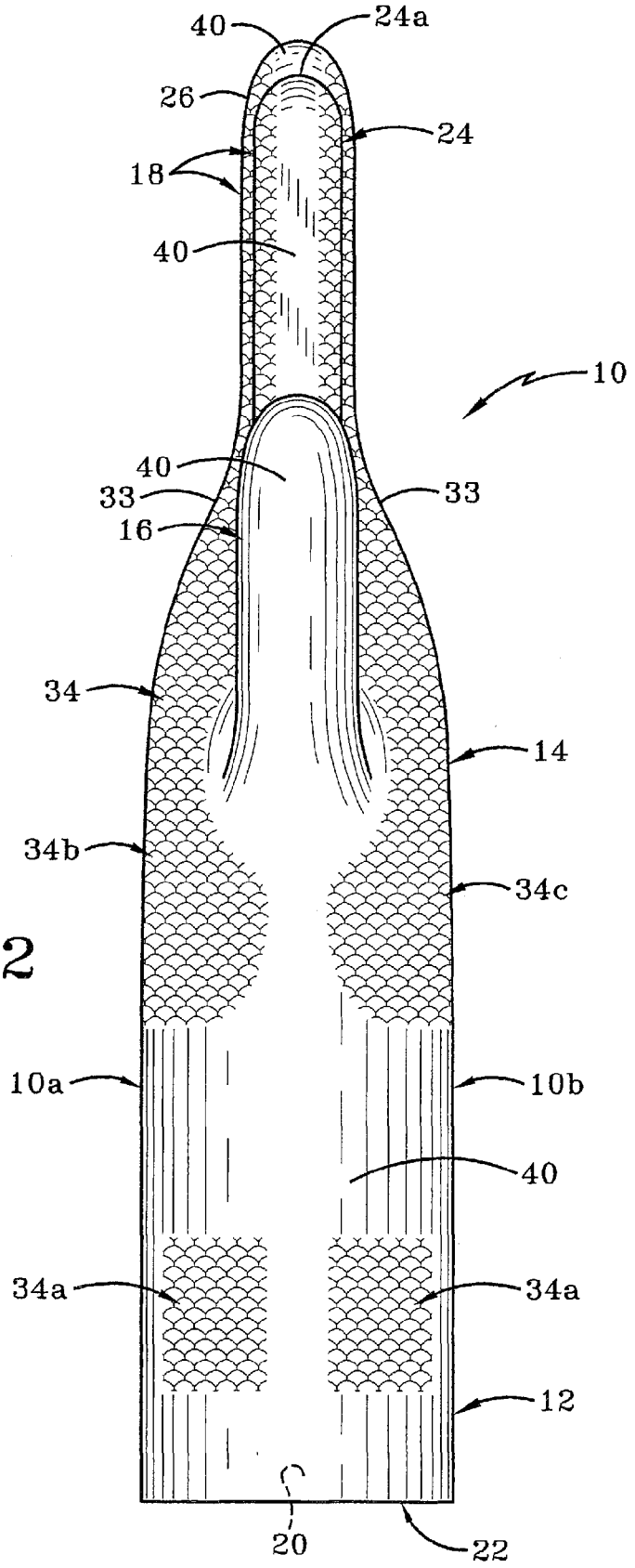
FIG. 2 is a right side view of the glove of FIG. 1 showing the finger regions and thumb region aligned with each other.

Index finger region 24 on glove 10 is very different when glove 10 is viewed from the side than the index finger regions of previously known gloves. Specifically, as shown in FIG. 2, index finger region 24 is substantially straight along its entire length from palm region 14 to the tip 24*a* thereof. The upper end of index finger region 4 does not tend to angle inwardly toward the front side 10*a* of glove 10. This more straight or planar configuration of index finger region 24 again makes it easier for glove 10 to be worn on either of a left and or a right hand. In previously known gloves, the upper end of the index finger region angled inwardly toward the front side of the glove and toward the center of the palm region.

As illustrated in FIG. 1, thumb region 16 has a circumference C3 and a length L3, index finger region 24 has a circumference C4 and a length L4, middle finger region 26 has a circumference C5 and a length L5, and ring finger region 28 has a circumference C6. Ring finger region 28 is also of a length L4 that is substantially equal to the length of index finger region 24. It will be understood, however that index and ring finger regions 24, 28 may be manufactured to be of different lengths relative to each other. Finally, little finger region 30 has a circumference C7 and a length L6. As shown in FIG. 3*b*, index finger region 24 of glove 10 is turned or rotated through 90 mm relative to the orientations of middle, ring and little finger regions 26, 28, 30 and thumb region 16 on axis "X". Index finger region 24 has a width "W1" and a depth "D1", middle finger region 26 has a width "W2" and a depth "D2", ring finger region 28 has a width "W3" and a depth "D3", and little finger region has a width "W4" and a depth "D4".

Furthermore, as illustrated in FIG. 3*a*, the industry standard prior art glove 75 also had all of the digit regions 77-83 oriented in a substantially identical manner relative to each other along axis "S". Width "W1 of index finger region 24 is substantially greater than the widths "W2", "W3", or "W4". (It should also be noted that width "W1" is also substantially greater than the width "W" of the index finger region 77 of the prior art glove 75.) Additionally, the depth "D1" of index finger 24 is smaller than the depths "D2", "D3" and "D4" of ring, middle and little finger regions 26, 28, 30. The index finger region 24 of glove 10 therefore has a turned or rotated appearance relative to finger regions 26, 28, 30. The changed orientation of index finger region 24 on glove 10 makes it is easier for a worker to insert either hand into the ambidextrous glove 10. The coplanar alignment of digit regions 18 and thumb region 16 of glove 10 and the rotation of index finger region 24 enables glove 10 to be worn on either of the left or right hand. By comparison, in the prior art glove 75 the non-coplanar arrangement of the finger regions 77-83 with thumb region 85 and the substantially identical orientation of the index finger region 77 with those of finger regions 79-83, only permits the prior art glove 75 to be worn on one or the other of the left and right hands. As indicated previously, FIG. 3*a* shows the prior art glove 75 configured to be worn only on the left hand.

The increased width "W1" of index finger region 24 provides glove 10 a wider and larger first work surface area 24*b* (FIG. 1) than would otherwise be possible. First work surface area 24*b* is substantially equal to the width "W1" and length L4 of index finger region 24. Since the width "W1" is greater than the width "W" of the prior art glove 75, the first work surface area 24*b* is substantially greater than the work surface area presented by the index finger region 77 of the prior art glove 75. Preferably, the first work surface area 24*b* is approximately 25% greater on glove 10 than the work surface area of index finger region 77 of the industry standard prior art glove 75. This increased work surface area presented by glove 10 of the present invention provides the worker with a much improved gripping action than was previously possible using prior art gloves 75.

It should also be noted that the overall dimensions of the former used to manufactured glove 10 are larger than the former used to manufacture prior art gloves of comparable size. So, for example, the dimensions of a former used to create a size 7 prior art glove 75 are smaller than the dimensions to create a size 7 glove 10 of the present invention. Appendix "B" sets out a comparison of the relative circumferences and lengths of a size 7 industry standard glove as compared with a size 7 glove in accordance with the present invention. Appendix "C" sets out a comparison of the pattern coverage in the prior art nitrile gloves and the nitrile gloves 110 of the present invention. Appendix "D" sets out the various dimensions of latex gloves in accordance with the present invention and Appendix "E" sets out the various dimensions of nitrile gloves in accordance with the present invention. It should be noted that the increased work surface area created by the increase in the circumferences of finger regions 24-30 results in an increase in pattern coverage in the range of from 20% to 35% over the pattern coverage of the finger regions 77-83 of prior art gloves 75 of comparable size. The resulting increase in the work surface area provides much improved finger-thumb grasping action over previously known gloves 75 and also provides more flexibility in the glove 10.

In accordance with a feature of the present invention, the circumference C1 of wrist region 12 on glove 10 has also been increased in the range of 14% over the circumference of the industry standard for the wrist region 12. For example, in an industry standard size 7 glove the circumference of the wrist region is 166 mm while on glove 10 of the present invention circumference C1 is 192 mm. This increase in wrist region circumference C1 over the industry standard makes it easier for the person to put the glove 10 on either of their left and right hands. The increased circumference C1 also makes it unnecessary to include any type of slit in wrist region 12 to make it easier to put on the glove.

Furthermore, the circumference C2 of palm region 14 has been increased by in the range of 14% over the industry standard. This makes glove 10 easier to wear on either of a left and right hand as the increased space within the interior of the glove bounded by palm region 14 accommodates the person's knuckles as the hand is clenched and released. Additionally, the extra space also permits the person to wear a liner (not shown) under glove 10 if so desired. The industry standard for the circumference of a palm region on a size 7 glove for example, is 177 mm, while the circumference C2 of the glove 10 in accordance with the present invention is 205 mm.

In accordance with yet another specific feature of the present invention, the circumferences C4 and C5 of index finger region 24 and middle finger region 26, respectively, are increased relative to the industry standard circumference for these components. For an industry standard size 7 glove for example, the circumference of an index finger region would be 55 mm and the circumference of a middle finger region would be 59 mm. In the glove 10 of the present invention, the circumference C4 of index finger region 24 is around 59 mm and the circumference C5 of middle finger region 26 is around 64 mm, an increase of in the range of from 7% to 8%. For an industry standard size 9 glove the circumference of an index finger region would be 65 mm and the circumference of a middle finger region would be 69 mm. In the glove 10 of the present invention of comparable size, the circumference C4 of index finger region 24 is 77 mm and the circumference C5 of middle finger region 26 is 82 mm. In the glove 10 of the present invention, the circumferences C4, C5 of index finger region 24 and middle finger region have each been increased by around 1 mm-5 mm and preferably by 2 mm-3 mm over the dimensions of the industry standard. The circumferences C6 and C7 of the ring and little finger regions 28, 30 on glove 10 are increased by in the range of 10% over those of the industry standard. Once again, the increased circumference of finger regions 18 makes it easier for a person to wear glove 10 on either hand.

The different orientation of index finger region 24 relative to the middle, ring and little finger regions 26, 28, 30, combined with the increased circumferences C4, C5 of index and middle finger regions 24, 26, makes it possible for a person to more easily insert either of their left or right hands into glove 10. These features also make it easier to wear and use the glove on either of a left and right hand as they aid in improving the fit of the glove in both hand orientations.

In accordance with yet another feature of the present invention, glove 10 has an increased distance "L" (FIG. 1) measured between the tip 24*a* of index finger region 24 and the thumb crotch 32 when compared to the distance measured between the tip of the index finger and thumb crotch on prior art gloves 75. In the industry standard size 9 glove for example, the thumb crotch is situated at a distance of 121 mm below the tip of the index finger region. In a size 9 glove of the present invention, thumb crotch 32 is situated at a distance "L" of 132 mm from the tip 24*a* of index finger region 24. In an industry standard size 10 glove the thumb crotch is situated at a distance of 125 mm below the tip of the index finger region. In the size 10 glove of the present invention, thumb crotch 32 is situated at a distance of 135 mm from tip 24*a* of the index finger region 24. Consequently, thumb crotch 32 of glove 10 is positioned around 11 mm lower than the thumb crotch of the industry standard. Over the range of different size gloves 10 in accordance with the present invention, the distance "L" preferably is in the range of from 9% to 12% greater than the distance between the thumb crotch and tip of the index finger of comparable size industry standard gloves. This increased distance "L" lets the glove slide down further on the worker's hand and provides increased flexibility in the thumb region 16 than was the case in industry standard gloves. Still further, this lower thumb crotch position also improves the fit of glove 10 when worn on either of a left or a right hand.

In accordance with a further specific feature of the present invention, glove 10 is provided with a gripping surface 34 on both of front and back surfaces 10*a*, 10*b* of glove 10. By contrast, if the industry standard gloves are provided with any type of gripping surface, that surface is only provided on the is front surface of the gloves. The gripping surface 34 of glove 10 takes the form of a textured pattern that is either embossed or molded into surfaces 10*a*, 10*b* or is applied externally thereto. Gripping surface 34 aids the person in gripping objects, especially wet or moist objects. FIG. 1 shows a first embodiment of a textured pattern used as gripping surface 34 of glove 10. This pattern preferably is a raised fan-shape or fish-scale shape pattern 34 that is provided in several zones on glove 10. The first of these zones is applied in an annular band 34*a* disposed proximate the end 22 of glove 10. Band 34*a* is substantially concentric with opening 20 in wrist region 12 and is provided to aid the worker in pulling gloves 10 onto or off from their hand. Band 34*a* may take the form of a substantially continuous annular band that circumscribes opening 20 or may, alternatively, and as is shown in the attached figures, take the form of a plurality of discrete regions of pattern that circumscribe wrist region 12.

The second of these patterned zones 34*b* is provided on front exterior surface 10*a* of glove 10 and extends over substantially all of the palm region 14 and all of the front surfaces of the index, middle, ring and little finger regions 24, 26, 28, 30 that may come into contact with an object when gripped. Patterned zone 34*b* preferably covers in the range of from 70% to 100% of palm region 14 and in the range of from 60% to 100% of digit regions 18. For instance, in the index finger region 24, the patterned zone 34*b* covers, in the range of 28% more of the work surface than is the case in the industry standard.

In accordance with a specific feature of the present invention, a third patterned zone 34*c* which is substantially identical to second patterned zone 34*b*, is provided on the rear exterior surface 10*b* of glove 10. Patterned zone 34*c* extends over substantially all of the palm region and the back surfaces of the index, middle, ring and little finger regions 24-30 that would come into contact with an object if the glove 10 were rotated through 180 mm. Consequently, patterned zone 34*c* covers in the range of from 70% to 100% of palm region 14 and in the range of from 60% to 100% of digit regions 18. Because the front and back exterior surfaces 10*a*, 10*b* of the glove 10 are substantially identical to each other, the second and third patterned zones 34*b*, 34*c* are located in substantially identical positions on the front and back surfaces. The substantially identical location of the zones 34*b*, 34*c* on the front and back exterior surfaces of glove 10 are provided so that no matter which of the left and right hand the glove is worn on, the person has substantially the same ability to grip the object they need to hold.

It should be noted that there are areas 40 of wrist region 12, palm region 14, thumb region 16 and digit regions 18 that do not necessarily need to be provided with the textured pattern as these areas are not located in areas that will touch an object when the person is gripping the same using the glove. The surface of glove 10 in areas 40 preferably is substantially smooth. Nonetheless, if desired, these areas 40 may also be provided with the pattern 34 embossed thereon.

A fourth patterned zone 34*d* is provided on the interior side 42 of thumb region 16. This zone 34*d* is provided on substantially the entire side 42 to aid the person in gripping objects. The remainder of the thumb region 16 and the crotch 32 comprises one of the un-textured areas 40. The fourth patterned zone 34*d* is provided on in the range of from 30% to 50% of the thumb region 16, of which substantially in the range of 100% of the fourth patterned zone 34*d* being provided on the interior side surface 42.

All of the first, second, third and fourth patterned zones 34*a*-34*d* preferably are provided with a fan-shaped or fish-scale pattern. This pattern aids in channeling moisture away from the surface of the glove that directly contacts the object being gripped and thereby reduces the tendency of the object to slip out of the person's hands. The textured surface also bites slightly into the exterior surface of the object being held, thereby physically aiding in gripping of the same. It will be understood that patterns other than the fan shape may be utilized in these zones. However, the provision of the fan-shaped pattern on glove 10 acts a visual aid to workers so that they can be sure they are wearing a glove manufactured especially for handling poultry, namely a glove manufactured from a material that does not readily break down upon exposure to chicken fat. The fan pattern provided on all the digit regions of glove 10 covers a larger area and provides a larger gripping work surface than any previously known hand specific prior art gloves, i.e., any previously known non-ambidextrous gloves.

Referring to FIG. 5, there is shown a second embodiment of an ambidextrous glove in accordance with the present invention and generally indicated at 110. Glove 110 is designed for use in the beef and pork processing and packaging industries and is therefore typically manufactured from a variety of synthetic rubbers such as acrylonitrile-butadiene (nitrile), polychloroprene or polyvinyl chloride. Glove 110 preferably is made of nitrile having about 40% solids. It will be understood, however, that any other material suitable for this purpose may be utilized.

Previously known waterproof gloves manufactured from latex and nitrile typically have been manufactured by dipping a former or mold into a vat of a liquid material, such as latex or nitrile. The former is dipped into the liquid, is removed therefrom, and then the liquid is allowed to solidify. This process typically has to be repeated two or three times to manufacture a glove of suitable thickness. When nitrile is used in the production of gloves, because there is a lower percentage of solids than is the case with natural rubber, there is a tendency for a meniscus bubble to be created in the spacing between adjacent finger regions. The bubble forms when the former is removed from the dip and it rides from the crotch region between adjacent fingers to the fingertip regions thereof. There is a tendency for these bubbles to burst and when a bubble does burst, it tends to transmit a quantity of material back to the crotch region, thereby creating a run in the glove by pulling material off the sides of the fingers. Additionally, when bubbles burst they will often break a hole in the side of a finger region.

Figure 6:
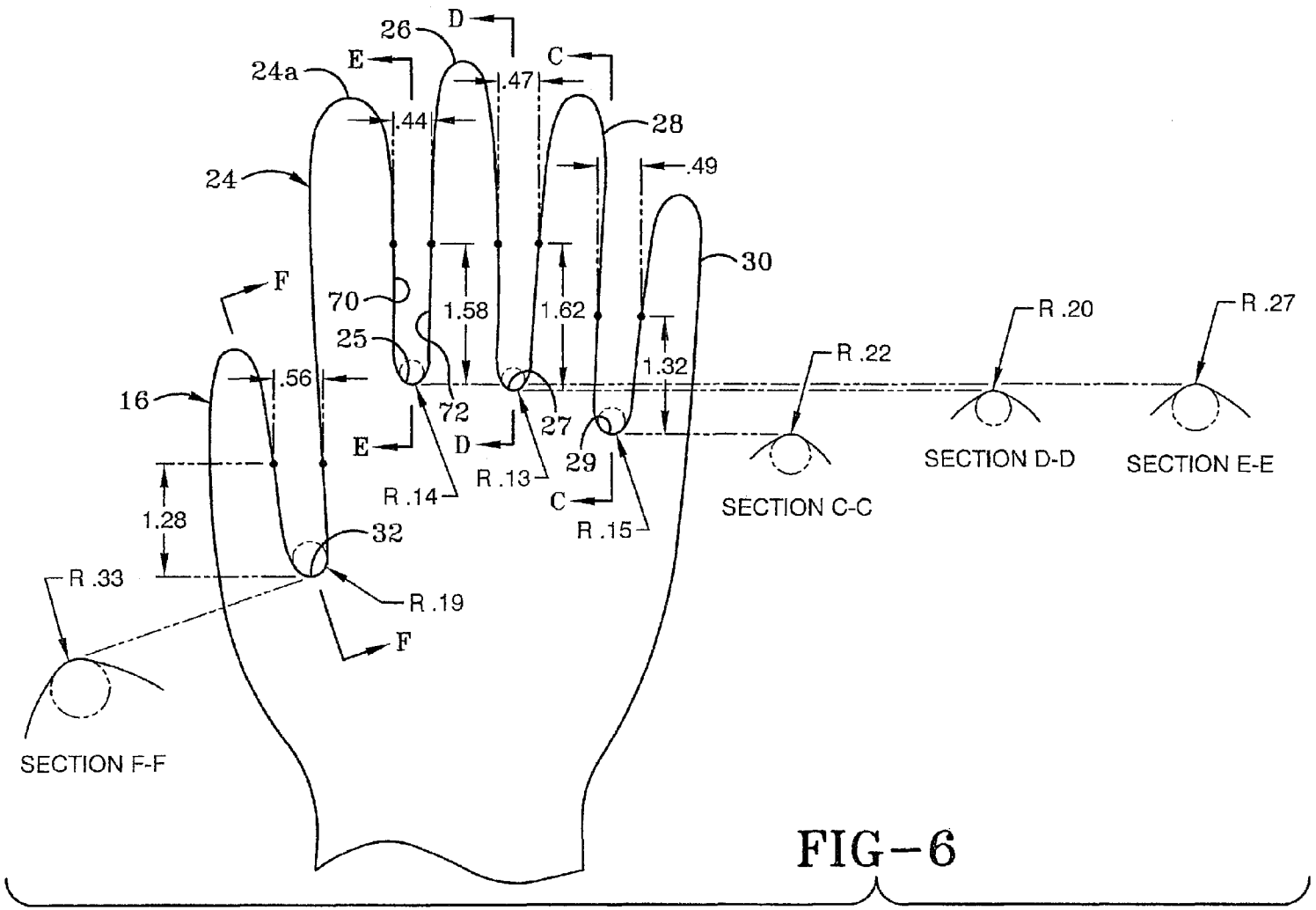
FIG. 6 is a front view of the ambidextrous glove in accordance with the present invention showing the radii of curvature of the crotch region between each pair of adjacent finger regions.

These production problems are addressed by the glove 110 of the present invention. In the present invention, the spacing of the crotch regions 25, 27, 29, 32 between adjacent finger regions 24-30 and index finger region 24 and thumb region 16 is substantially very even and is somewhat larger than was provided in previously known gloves. The distance between thumb region 16 and index finger region 24 is 0.56 cm (or 56 mm), the distance between index finger region 24 and middle finger region 26 is 0.44 cm (or 44 mm), the distance between middle finger region 26 and ring finger region 28 is 0.47 cm (or 47 mm), and ring finger region 28 and little finger region 30 is 0.49 cm (or 49 mm). The locations on the finger regions and thumb region where these distance measurements are taken can be seen in FIG. 6. FIG. 6 also shows the radii of curvature of crotch regions 25, 27, 29, 32. As a result of these changes in glove 110, there is little to no meniscus bubble formation in these crotch regions when nitrile is used and, consequently, less damage to gloves 110 during production. Appendix "F" sets out the thicknesses of the materials used in the industry standard gloves and gloves 10, 110 in accordance with the present invention.

Glove 110 is substantially identical in configuration to glove 10 in that it includes a wrist region 112, a palm region 114, a thumb region 116 and four digit regions 118. Digit regions 118 include an index finger region 124, middle finger region 126, ring finger region 128 and little finger region 130. The only difference between glove 10 and glove 110 is that the latter is provided with a raised diamond-shaped pattern in the gripping zones 134*a*, 134*b* and 134*d* instead of the fan-shaped pattern provided on glove 10. (As with glove 10, the back surface of glove 110, which is not illustrated herein, is provided with a substantially identical patterned zone to that of 134*c*). The raised diamond-shaped pattern provided in the zones 134 serves exactly the same function as that of the pattern in the zones 34 of glove 10. Consequently, the raised diamond-shaped pattern aids the worker in gripping objects and channels any moisture away from the surfaces of glove 110 that directly contact the object being held and also provides a visual aid to these worker to know that they are using a glove that is appropriate for handling meats other than chicken, i.e., beef, pork, lamb, goat etc.

FIG. 6 applies equally to both of the first and second embodiments of glove 10, 110 and illustrates the glove oriented for placement on the right hand. The following description will reference glove 10 but should be understood to apply equally to glove 110. The pattern on the surface of glove 10 has been omitted from this figure for clarity. As will be understood by those skilled in the art, glove 10 includes curved regions between adjacent digits and these regions curve in two different directions. Firstly, there is curvature as one moves down the interior side of one finger region and up the interior side of the adjacent is finger region. For example, an index finger crotch 25 is disposed between index and middle finger regions 24, 26. A middle finger crotch 27 is disposed between middle finger region 26 and ring finger region 28. A ring finger crotch 29 is disposed between ring finger region 28 and little finger region 30, and thumb crotch 32 is disposed between index finger region 24 and thumb region 16. Each of the crotch regions, 27, 29, 32 curves in two different directions. Firstly, the regions curve as you move down an interior side surface of one digit, through the crotch region and up the interior side surface of the adjacent digit. For example, index finger crotch 25 curves in the direction illustrated in FIG. 6 as you move down the interior side surface 70 of index finger region 24, through index finger crotch 25 and up the interior side surface 72 of middle finger region 26. This type of curvature will be denoted hereinafter as being a "first radius of curvature". Secondly, as shown in FIG. 3 and in the Sections C-C, D-D, E-E, and F-F of FIG. 6, each of the crotch regions curves as you transition from the front surface 10*a* of glove 10 to the back surface 10*b* thereof. This type of curvature will be denoted hereinafter as being a "second radius of curvature".

With reference to the index finger crotch 25, the first radius of curvature is about 14 mm and the second radius of curvature (shown in Section E-E) is about 22 mm. With reference to the middle finger crotch 27, the first radius of curvature is about 13 mm and the second radius of curvature (shown in Section D-D) is about 20 mm. With reference to the ring finger crotch 29, the first radius of curvature is about 15 mm and the second radius of curvature (shown in Section C-C) is about 27 mm. With reference to thumb crotch 32, the first radius of curvature is about 19 mm and the second radius of curvature (shown in Section F-F) is about 33 mm.

Still further, glove 10 has a third radius of curvature in the region indicated by the reference characters 33 on FIG. 2. The third radius of curvature is the curvature in the zone where finger regions 18 transition to palm region 14. In the present invention, this third radius of curvature gives palm region 14 a tighter or sharper curve than was the case in previously known gloves. When nitrile is used in the production of glove 110, this third radius of curvature is provided on the glove former, and together with the lower solid content of the material, the curvature tends to create a more even thickness product as there is less running of the material in the palm region 114 of glove 110. It has also been found that it is about 25% faster to do a production run with a glove former having this third radius of curvature configuration than was the case with industry standard formers. Furthermore, only one dip of the former into the liquid nitrile is required to produce glove 110 of the present invention, whereas in the past it was necessary to dip the industry standard formers at least twice into liquid nitrile material. Thus, the present invention requires less raw-material for the production of glove 110 and produces a product of more consistent quality.

The gloves 10, 110 of the present invention are used by orienting them in the appropriate manner so that they may be pulled onto either of a right hand or a left hand. A food processing and packaging plant need only provide boxes of the ambidextrous gloves in the various sizes for their workers to use. If a glove becomes damaged or punctured during use, the worker can simply pull that single glove off their hand and dispose of the same. The undamaged glove on their other hand does not need to be removed and thrown away. The worker then selects a single ambidextrous replacement glove from the appropriate container and puts it on the exposed hand. In this way, the ambidextrous glove in accordance with the present invention tends to reduce the quantity of gloves used by a processing facility.

Gloves 10, 110 are designed so as to be disposable, throw away gloves.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

APPENDIX A

PRIOR ART - INDUSTRY STANDARD HAND FORMER SPECIFICATION MD-6 (SHARP FINGER) (All dimensions are in mm)

| | Size | | | | |
|---|---|---|---|---|---|
| Description | SS (6) | S (7) | M (8) | L (9) | XL (10) |
| Height of Hand | 400 | 400 | 400 | 400 | 400 |
| Length of Hand | 181 | 193 | 198 | 217 | 220 |
| Palm Circumference | 168 | 177 | 200 | 228 | 235 |
| Wrist Circumference | 151 | 166 | 180 | 193 | 204 |
| Shank Circumference | 181 | 199 | 208 | 209 | 220 |
| Thumb length (1) | 49 | 53 | 55 | 58 | 63 |
| Index finger length (2) | 64 | 67 | 72 | 73 | 75 |
| Middle finger length (3) | 76 | 79 | 83 | 84 | 85 |
| Ring finger length (4) | 67 | 71 | 75 | 75 | 79 |
| Little finger length (5) | 47 | 54 | 56 | 59 | 62 |
| Thumb Circumference (1) | 57 | 60 | 65 | 73 | 80 |
| Index finger circumference (2) | 51 | 55 | 61 | 65 | 69 |
| Middle finger circumference (3) | 54 | 59 | 64 | 69 | 73 |
| Ring finger circumference (4) | 51 | 54 | 59 | 64 | 68 |
| Little finger circumference (5) | 44 | 47 | 52 | 57 | 61 |

APPENDIX B

Comparison of Small Prior Art Glove (P) with Size 7 Ambidextrous Latex Glove (A1) and Size 7 Ambidextrous Nitrile Glove (A2) of the Present Invention (All dimensions are in mm)

| Description | (P) | (A1) | Deviation | % Difference | (A2) | Deviation | % Difference |
|---|---|---|---|---|---|---|---|
| Height of Hand | 400 | 400 | 0 | 0% | 400 | 0 | 0% |
| Length of Hand | 193 | 193 | 0 | 0% | 193 | 0 | 0% |
| Palm Circumference | 177 | 210 | 33 | 19% | 187 | 10 | 14% |
| Wrist Circumference | 166 | 195 | 29 | 17% | 178 | 12 | 14% |
| Shank Circumference - Beading | 199 | 236 | 37 | 19% | 228 | 29 | 15% |
| Thumb length | 53 | 57 | 4 | 6% | 55 | 2 | 5% |
| Index finger length | 67 | 76 | 9 | 13% | 74 | 7 | 11% |
| Middle finger length | 79 | 85 | 6 | 7% | 83 | 4 | 7% |
| Ring finger length | 71 | 78 | 7 | 10% | 74 | 3 | 8% |
| Little finger length | 54 | 63 | 9 | 17% | 55 | 2 | 5% |
| Thumb Circumference | 60 | 69 | 9 | 13% | 64 | 4 | 13% |
| Index finger circumference | 55 | 62 | 7 | 13% | 58 | 3 | 7% |
| Middle finger circumference | 59 | 70 | 11 | 19% | 62 | 3 | 8% |
| Ring finger circumference | 54 | 63 | 9 | 17% | 55 | 1 | 10% |
| Little finger circumference | 47 | 55 | 8 | 17% | 48 | 1 | 2% |
| Thumb Pattern coverage | 19 | 25 | 6 | 24 | 20 | −1 | −5% |

APPENDIX B-continued

Comparison of Small Prior Art Glove (P) with Size 7 Ambidextrous Latex Glove (A1) and Size 7 Ambidextrous Nitrile Glove (A2) of the Present Invention (All dimensions are in mm)

| Description | (P) | (A1) | Deviation | % Difference | (A2) | Deviation | % Difference |
|---|---|---|---|---|---|---|---|
| Index Finger Pattern Coverage | 14 | 19 | 5 | 27% | 18 | 6 | 34% |
| Middle Finger Pattern Coverage | 14 | 20 | 6 | 30% | 19 | 6 | 32% |
| Ring Finger Pattern Coverage | 13 | 20 | 7 | 35% | 17 | 5 | 30% |
| Little Finger Pattern Coverage | 13 | 17 | 4 | 24% | 14 | 4 | 29% |
| Index Finger to Thumb Crotch Distance | 113 | 120 | 7 | 6% | 120 | 7 | 6% |

APPENDIX C

Comparison of Prior Art Nitrile Gloves (P) and Nitrile Gloves (A2) of the Present Invention
Nitrile Pattern Coverage by Percentage
Average and Percent of Difference

| | P | A2 | |
|---|---|---|---|
| | Size | | |
| | 7 | 7 | |
| Thumb | 21 | 20 | −5% |
| Index | 12 | 18 | 34% |
| Middle | 13 | 19 | 32% |
| Ring | 12 | 17 | 30% |
| Little | 10 | 14 | 29% |
| | Size | | |
| | 8 | 8 | |
| Thumb | 27 | 22 | −19% |
| Index | 14 | 18 | 23% |
| Middle | 15 | 18 | 17% |
| Ring | 13 | 16 | 19% |
| Little | 11 | 15 | 27% |
| | Size | | |
| | 9 | 9 | |
| Thumb | 30 | 26 | −14% |
| Index | 15 | 22 | 32% |
| Middle | 17 | 22 | 23% |
| Ring | 16 | 20 | 20% |
| Little | 13 | 20 | 35% |
| | Size | | |
| | 10 | 10 | |
| Thumb | 32 | 31 | −4% |
| Index | 20 | 26 | 24% |
| Middle | 18 | 22 | 19% |
| Ring | 16 | 20 | 20% |
| Little | 15 | 20 | 20% |
| | Size | | |
| | 11 | 11 | |
| Thumb | 33 | 40 | 18% |
| Index | 21 | 27 | 23% |
| Middle | 22 | 27 | 19% |
| Ring | 20 | 24 | 17% |
| Little | 20 | 22 | 10% |

APPENDIX D

DIMENSIONS OF DIFFERENTLY SIZED LATEX, FAN PATTERNED GLOVES IN ACCORDANCE WITH THE PRESENT INVENTION

| Description | Size 7 | Size 8 | Size 9 | Size 10 | Size 11 |
|---|---|---|---|---|---|
| Total Length | 400 | 400 | 400 | 400 | 400 |
| Palm Circumference | 210 | 240 | 265 | 274 | 305 |
| Wrist Circumference | 195 | 220 | 238 | 255 | 269 |
| Shank Circumference - Beading | 236 | 248 | 264 | 268 | 290 |
| Thumb length | 57 | 62 | 68 | 68 | 82 |
| Index finger length | 76 | 75 | 80 | 86 | 95 |
| Middle finger length | 85 | 89 | 90 | 95 | 108 |
| Ring finger length | 78 | 80 | 82 | 85 | 95 |
| Little finger length | 59 | 63 | 68 | 74 | 80 |
| Thumb Circumference | 69 | 82 | 91 | 88 | 94 |
| Index finger circumference | 62 | 71 | 87 | 83 | 91 |
| Middle finger circumference | 70 | 79 | 90 | 91 | 97 |
| Ring finger circumference | 63 | 72 | 80 | 86 | 92 |
| Little finger circumference | 55 | 64 | 72 | 76 | 86 |
| Dist. Thumb crotch to index finger tip | 120 | 124 | 132 | 135 | 134 |
| Breadth of socket | 80 | 80 | 80 | 80 | 80 |
| Width of socket | 80 | 80 | 80 | 80 | 80 |
| Breadth of socket slot | 55 | 55 | 55 | 55 | 55 |
| Width of socket slot | 25 | 25 | 25 | 25 | 25 |
| Base plate thickness | 12 | 12 | 12 | 12 | 12 |

Tolerances:

| | |
|---|---|
| Former Height: | 400 mm ± 5 mm |
| Circumferences: | ±3 mm of nominal values<br>±3 mm for fingers |
| Finger length: | ±3 mm |

APPENDIX E

DIMENSIONS OF DIFFERENTLY SIZED NITRILE, DIAMOND PATTERNED GLOVES IN ACCORDANCE WITH THE PRESENT INVENTION

| Description | Size 7 | Size 8 | Size 9 | Size 10 | Size 11 | Size 12 |
|---|---|---|---|---|---|---|
| Total Length | 400 | 400 | 400 | 400 | 400 | 400 |
| Palm Circumference | 187 | 210 | 240 | 265 | 274 | 280 |
| Wrist Circumference | 178 | 195 | 220 | 238 | 265 | 275 |
| Shank Circumference - Beading | 228 | 236 | 248 | 257 | 268 | 280 |
| Thumb length | 55 | 57 | 62 | 68 | 68 | 71 |
| Index finger length | 74 | 76 | 75 | 80 | 86 | 88 |
| Middle finger length | 83 | 85 | 89 | 90 | 95 | 98 |
| Ring finger length | 74 | 78 | 80 | 82 | 85 | 89 |
| Little finger length | 55 | 59 | 63 | 68 | 74 | 74 |
| Thumb Circumference | 64 | 69 | 82 | 91 | 92 | 96 |
| Index finger circumference | 58 | 62 | 71 | 87 | 88 | 92 |

APPENDIX E-continued

DIMENSIONS OF DIFFERENTLY SIZED NITRILE, DIAMOND PATTERNED GLOVES IN ACCORDANCE WITH THE PRESENT INVENTION

| Description | Size 7 | Size 8 | Size 9 | Size 10 | Size 11 | Size 12 |
|---|---|---|---|---|---|---|
| Middle finger circumference | 62 | 70 | 79 | 90 | 91 | 94 |
| Ring finger circumference | 55 | 63 | 72 | 80 | 86 | 90 |
| Little finger circumference | 45 | 55 | 64 | 72 | 76 | 78 |
| Dist. Thumb crotch to index finger tip | 120 | 120 | 124 | 132 | 137 | 140 |
| Breadth of socket | 80 | 80 | 80 | 80 | 80 | 80 |
| Width of socket | 80 | 80 | 80 | 80 | 80 | 80 |
| Breadth of socket slot | 55 | 55 | 55 | 55 | 55 | 55 |
| Width of socket slot | 25 | 25 | 25 | 25 | 25 | 25 |
| Base plate thickness | 12 | 12 | 12 | 12 | 12 | 12 |

Tolerances:

| | |
|---|---|
| Former Height: | 400 mm ± 5 mm |
| Circumferences: | ±3 mm of nominal values<br>±3 mm for fingers |
| Finger length: | ±3 mm |

APPENDIX F

THICKNESS OF MATERIAL USED IN PREVIOUSLY KNOWN GLOVES RELATIVE TO THE GLOVES OF THE PRESENT INVENTION

| Throw Away | Nitrile | Natural Rubber |
|---|---|---|
| Previous Throw-Away | 3-8 ml | 4-12 ml |
| Present Ambidextrous Throw-Away | 3-8 ml | 4-12 ml |
| Previous Reusable | 9-25 ml | 10-50 ml |
| Present Ambidextrous Reusable | 9-20 ml | 10-25 ml |

The invention claimed is:

1. A glove comprising:

a palm region adapted to cover a palm and back of a person's hand;

a thumb region extending outwardly from the palm region;

an index finger region disposed adjacent the thumb region;

a middle finger region adjacent the index finger region;

a ring finger region adjacent the middle finger region; and a little finger region adjacent the ring finger region; wherein the index finger region is rotated through 90° relative to the middle finger region, the ring finger region and the little finger region; and wherein the glove is an ambidextrous glove that is wearable on either of a left and a right hand of a wearer; and the glove has an inside surface adapted to contact the wearer's left or right hand, and wherein the glove further includes a flocking material applied to at least a portion of the inside surface of the glove.

2. The glove as defined in claim 1, wherein the glove is a disposable ambidextrous glove.

3. The glove as defined in claim 1, wherein the flocking is a cotton material or a rayon material that is deposited on at least the portion of the inside surface of the glove.

4. The glove as defined in claim 3, wherein the glove further includes a wrist region extending outwardly from the palm region in the opposite direction to the thumb region, index finger region, the middle finger region, the ring finger region, and the little finger region.

5. The glove as defined in claim 4, wherein the inside surface extends through the wrist region and the flocking is applied to at least a portion of the wrist region.

6. The glove as defined in claim 4, wherein the inside surface extends through the wrist region and the flocking is deposited on the one or more of the palm region, the thumb region, the index finger region, the middle finger region, the ring finger region, the little finger region, and the wrist region.

7. The glove as defined in claim 1, wherein the index finger region, middle finger region, ring finger region, little finger region and thumb region are substantially aligned with each other along a common axis.

8. The glove as defined in claim 7, wherein the index finger region is oriented at ninety degrees relative to the common axis.

9. The glove as defined in claim 4, wherein the wrist region is free of any slits.

10. The glove as defined in claim 4, wherein the wrist region is free of any cuffs or fastening mechanisms.

11. The glove as defined in claim 1, further comprising a textured pattern provided on an exterior surface of one or more of the palm region, thumb region, index finger region, middle finger region, ring finger region, and little finger region.

12. The glove as defined in claim 11, wherein the textured pattern is provided on an exterior surface of both a front and a back of the glove.

13. The glove as defined in claim 11, wherein the textured pattern comprises a gripping surface formed from one of a plurality of raised fan-shaped areas and raised diamond-shaped areas disposed in abutting contact with each other and embossed on the exterior surface.

14. The glove as defined in claim 13, wherein said palm region, thumb region, index finger region, middle finger region, ring finger region, and little finger region are molded from natural rubber latex.

15. The glove as defined in claim 11, wherein the gripping surface is formed from a plurality of raised diamond-shaped areas disposed in abutting contact with each other and the palm region, thumb region, index finger region, middle finger region, ring finger region, and little finger region are molded from a synthetic rubber consisting of one of acrylonitrile-butadiene, polychloroprene or polyvinyl chloride.

16. The glove as defined in claim 11, wherein the glove is disposable and has a front exterior surface adapted to cover a front region of the wearer's hand, and has a back exterior surface adapted to cover a back region of the wearer's hand; and wherein each of the front and back exterior surfaces is provided with a textured gripping pattern in substantially identical locations.

17. The glove as defined in claim 1, wherein:

the index finger region has a length and a circumference;

the middle finger region has a length and a circumference;

the ring finger region has a length and a circumference;

the little finger region has a length and a circumference; and the thumb region has a length and a circumference, and a thumb crotch is defined between the index finger region and the thumb region and is disposed a distance from a tip of the index finger region; and wherein the thumb crotch distance is in the range of from 9% to 12% greater than the industry standard thumb crotch distance.

* * * * *